US010237661B2

(12) United States Patent
Cai et al.

(10) Patent No.: US 10,237,661 B2
(45) Date of Patent: Mar. 19, 2019

(54) SPEAKER DEVICE

(71) Applicant: GOERTEK INC., WeiFang, Shandong (CN)

(72) Inventors: Xiaodong Cai, WeiFang (CN); Cheng Zhang, WeiFang (CN)

(73) Assignee: GOERTEK, INC., Weifang, Shandong (CN)

( * ) Notice: Subject to any disclaimer, the term of this patent is extended or adjusted under 35 U.S.C. 154(b) by 0 days.

(21) Appl. No.: 15/567,943

(22) PCT Filed: Nov. 16, 2015

(86) PCT No.: PCT/CN2015/094671

§ 371 (c)(1),
(2) Date: Oct. 19, 2017

(87) PCT Pub. No.: WO2016/169254

PCT Pub. Date: Oct. 27, 2016

(65) Prior Publication Data

US 2018/0109879 A1 Apr. 19, 2018

(30) Foreign Application Priority Data

Apr. 22, 2015 (CN) ..... 2015 1 0194549

(51) Int. Cl.
*H04R 9/06* (2006.01)
*H04R 7/12* (2006.01)
(Continued)

(52) U.S. Cl.
CPC ..... *H04R 9/06* (2013.01); *H04R 7/12* (2013.01); *H04R 9/025* (2013.01); *H04R 9/046* (2013.01);
(Continued)

(58) Field of Classification Search
CPC ... H04R 7/12; H04R 7/24; H04R 9/06; H04R 9/046; H04R 17/00; H04R 23/02; H04R 31/006
See application file for complete search history.

(56) References Cited

U.S. PATENT DOCUMENTS 7,716,808 B2 * 5/2010 Hutt ..... B60R 11/0223 156/250
2016/0286320 A1 * 9/2016 Stein (ne Schulze) ..... H04R 1/1008

FOREIGN PATENT DOCUMENTS

CN 201523448 U 7/2010
CN 101998216 A 3/2011
(Continued)

OTHER PUBLICATIONS

International Search Report and Written Opinion, dated Jan. 27, 2016, State Intellectual Property Office of the P.R. China.

*Primary Examiner* — Tuan D Nguyen
(74) *Attorney, Agent, or Firm* — Holzer Patel Drennan

(57) ABSTRACT

A speaker device comprises a vibration system, a magnetic circuit system, and an auxiliary system for accommodating and fixing the magnetic circuit system and the vibration system. The vibration system comprises a diaphragm, a centering disk and a voice coil which are joined together. The centering disk comprises a first fixing portion, a second fixing portion provided within the first fixing portion, and a connecting arm connecting the first fixing portion and the second fixing portion. A central position of the second fixing portion is provided with a piezoelectric sheet, the centering disk is provided with a first pad corresponding to the piezoelectric sheet, and the piezoelectric sheet is electrically connected to the first pad. Since a signal emitted by the piezoelectric sheet is mixed with an audio signal emitted by the voice coil-diaphragm, the speaker device of the present
(Continued)

invention has improved medium-high frequency effect and acoustic performance.

8 Claims, 2 Drawing Sheets

(51) Int. Cl.

| | |
|---|---|
| ***H04R 9/02*** | (2006.01) |
| ***H04R 9/04*** | (2006.01) |
| ***H04R 17/00*** | (2006.01) |
| ***H04R 23/02*** | (2006.01) |
| *H04R 31/00* | (2006.01) |

(52) U.S. Cl.
CPC ..... *H04R 17/00* (2013.01); *H04R 23/02* (2013.01); *H04R 31/006* (2013.01)

(56) References Cited

FOREIGN PATENT DOCUMENTS

| | | | |
|---|---|---|---|
| CN | 102281488 | A | 12/2011 |
| CN | 204131721 | U | 1/2015 |
| CN | 104822114 | A | 8/2015 |
| CN | 204616078 | U | 9/2015 |

* cited by examiner

SPEAKER DEVICE

TECHNICAL FIELD

The present invention relates to the field of electroacoustics, and more particularly, to a speaker device having good medium-high frequency performance.

BACKGROUND ART

With the development of science and technology, portable electronic devices attract widespread attention. As a major sound generation unit of a portable electronic terminal, a speaker device directly affects the use effects of the portable electronic devices. With increasingly improved requirements for audio effects of the portable electronic terminals, the acoustic performance of the speaker devices attracts more and more attention.

A conventional speaker device comprises a vibration system, a magnetic circuit system and an auxiliary system. The auxiliary system is used for accommodating and fixing the vibration system and the magnetic circuit system. The vibration system comprises a voice coil, a diaphragm and a centering disk. A central position of the centering disk is provided with a reinforcement portion. The magnetic circuit system comprises a magnet and a magnetic conductive piece. The magnetic circuit system is provided with a magnetic gap, into which the voice coil is provided. As current of the conductive voice coil in the magnetic field changes, the voice coil vibrates under Lorentz force, and thereby driving the diaphragm to vibrate to make a sound. For the speaker device of this structure, its high-frequency frequency response curve may fall sharply in a dozen of KHz, which may generate a high-frequency cutoff frequency, making it impossible to generate acoustic waves higher in frequency and better in acoustic quality. Due to limitations on materials and process of conventional speaker devices, it is difficult to increase the high frequency cut-off frequency, and it is also difficult to significantly improve the medium-high frequency effect of the speaker devices.

Therefore, it is necessary to provide an improved speaker device to overcome the defects of the speaker devices in the prior art.

SUMMARY

A technical problem to be solved by the present invention is to provide a speaker device having good medium-high frequency effect.

In order to achieve the above objectives, the present invention adopts the following technical solutions.

A speaker device comprises a vibration system, a magnetic circuit system, and an auxiliary system for accommodating and fixing the magnetic circuit system and the vibration system. The vibration system comprises a diaphragm, a centering disk and a voice coil which are joined together. The centering disk comprises a first fixing portion, a second fixing portion provided within the first fixing portion, and a connecting arm connecting the first fixing portion and the second fixing portion. A central position of the second fixing portion is provided with a piezoelectric sheet, the centering disk is provided with a first pad corresponding to the piezoelectric sheet, and the piezoelectric sheet is electrically connected to the first pad.

As a preferred technical solution, the second fixing portion has an annular structure, and an outer periphery of the piezoelectric sheet is fixedly joined with the second fixing portion.

As a preferred technical solution, the diaphragm comprises a fixing portion, a plane portion at the center, and a suspension ring portion connecting the fixing portion and the plane portion. The plane portion is fixedly joined with the second fixing portion of the centering disk.

As a preferred technical solution, the centering disk is provided with a second pad, which is electrically connected to the voice coil.

As a preferred technical solution, both the first pad and the second pad are provided at the second fixing portion. As a still further technical solution, the piezoelectric sheet is provided at a side of the second fixing portion away from the diaphragm.

As a still further preferred technical solution, the first fixing portion is provided with a first external pad and a second external pad, wherein the first external pad is electrically coupled with the first pad, and the second pad is electrically coupled with the second external pad.

As a still further preferred technical solution, the centering disk is provided with a conductive circuit. Each of the first fixing portion, the second fixing portion and the connecting arm is provided with the conductive circuit.

As a preferred technical solution, the auxiliary system comprises a front cover and a housing.

As a further preferred technical solution, the centering disk is fixedly provided between the front cover and the housing.

In the speaker device of the present invention, a piezoelectric sheet is fixed to the second fixing portion of the centering disk, the centering disk is provided with a first pad corresponding to the piezoelectric sheet, and the piezoelectric sheet is electrically connected to the centering disk and then is electrically connected to an external circuit. According to the speaker device of the present invention, the piezoelectric sheet is used to replace a reinforcement portion provided at the central position of the centering disk of the speaker device having a conventional structure, such that the piezoelectric sheet may play the role of the reinforcement portion to improve the acoustic performance of the speaker device; meanwhile, as an independent sound generation unit, the piezoelectric sheet may generate medium-high frequency audio signals, which may supplement the audio signal generated by the voice coil-diaphragm sound generation structure of the present invention. A signal emitted by the piezoelectric sheet is mixed with an audio signal emitted by the voice coil-diaphragm, such that a medium-high frequency effect of the speaker device is effectively improved, and the acoustic performance of the speaker device is improved.

DETAILED DESCRIPTION OF EMBODIMENTS

Hereinafter, the present invention will be described in detail with reference to the accompanying drawings.

Figure 1:
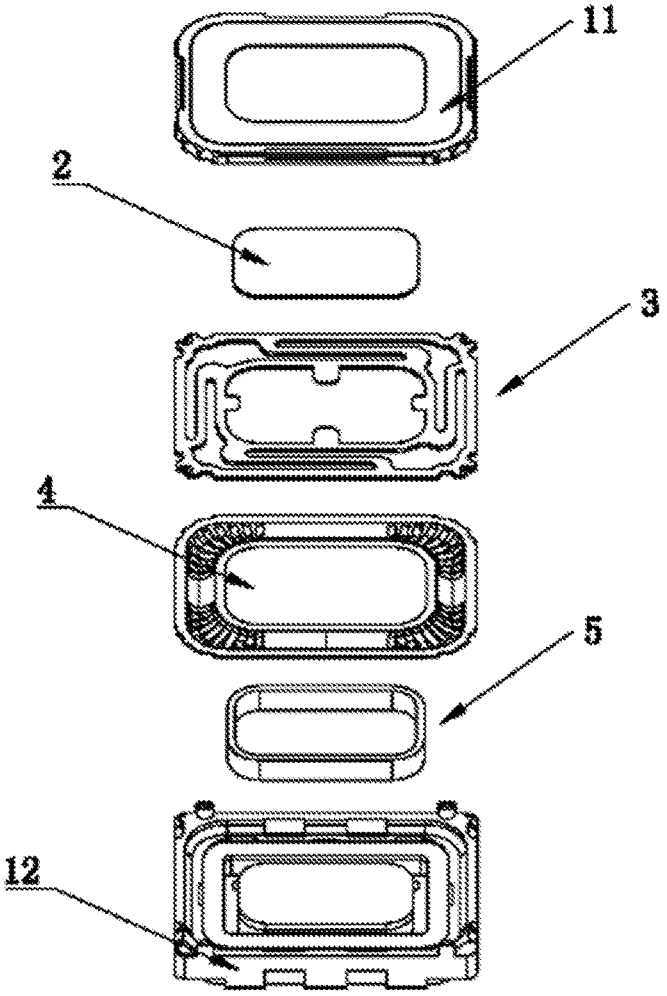
FIG. 1 is an exploded view of a speaker device according to a specific embodiment of the present invention.
Figure 2:
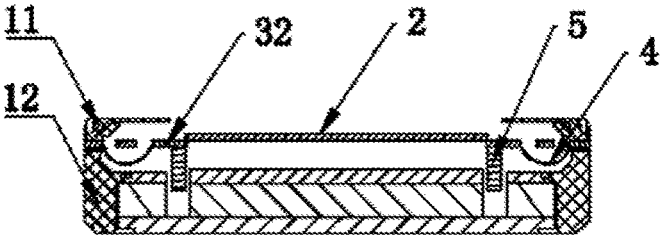
FIG. 2 is a section view of the speaker device as shown in FIG. 1.

As shown in FIG. 1 and FIG. 2, the specific embodiment according to the speaker device of the present invention comprises a vibration system, a magnetic circuit system and an auxiliary system. The auxiliary system comprises a front cover 11 and a housing 12. The front cover 11 fits with the housing 12 to accommodate and fix the vibration system and the magnetic circuit system. The vibration system comprises a diaphragm 4, a centering disk 3 and a voice coil 5 fixedly joined with the diaphragm 4. The magnetic circuit system comprises a magnet and a magnetic conductive member. As shown in FIG. 2, the magnetic circuit system is provided with a magnetic gap, into which the voice coil 5 suspends. When an external electrical signal enters into the voice coil 5, current of the voice coil 5 positioned in the magnetic field changes, so that the voice coil 5 vibrates up and down by Lorentz force. Vibration of the voice coil 5 drives the diaphragm 4 to vibrate, and vibration of the diaphragm 4 incites air to make sounds.

Figure 3:
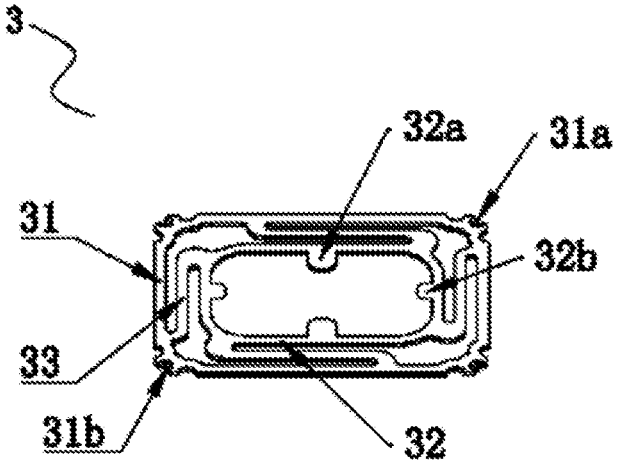
FIG. 3 is a perspective view of the centering disk in FIG. 1.

As shown in FIG. 3, in the speaker device of the present invention, the centering disk 3 comprises a first fixing portion 31, and a second fixing portion 32 provided in the first fixing portion 31. The first fixing portion 31 is connected to the second fixing portion 32 through a connecting arm 33. As shown in FIG. 1 and FIG. 2, a central position of the second fixing portion 32 of the centering disk 3 is provided with a piezoelectric sheet 2. In the piezoelectric speaker of the present invention, as another sound source, the piezoelectric sheet 2 cooperates with the sound source composed of the voice coil-diaphragm. The sound produced by the piezoelectric sheet 2 has good high frequency effect, and thereby supplementing the audio signal emitted by the voice coil-diaphragm sound generation structure. A signal emitted by the piezoelectric sheet 2 is mixed with an audio signal emitted by the voice coil-diaphragm, such that a medium-high frequency effect of the speaker device is effectively improved, and the acoustic performance of the speaker device is improved.

As shown in FIG. 3, the second fixing portion 32 is provided with a group of first pads 32*a*. In the assembly and manufacturing process of the speaker device of the present invention, the piezoelectric sheet 2 is electrically connected to the first pads 32*a*, and the piezoelectric sheet 2 is electrically connected to the external circuit through the centering disk 3.

As shown in FIG. 3, in the speaker device of the embodiment, the second fixing portion 32 of the centering disk 3 has an annular structure. In the manufacturing process of the speaker device of the embodiment, an outer periphery of the piezoelectric sheet 2 is fixedly joined with the second fixing portion 32. Since the second fixing portion 32 has an annular structure, the weight of the vibration system is reduced, and the acoustic performance of the speaker device is improved.

As shown in FIG. 1 and FIG. 2, in the speaker device of the embodiment, the diaphragm 4 comprises a fixing portion, a plane portion provided at a central position in the fixing portion, and a suspension ring portion connecting the fixing portion and the plane portion. As shown in FIG. 2, the plane portion of the diaphragm 4 is joined with the second fixing portion of the centering disk 3, and the fixing portion of the diaphragm 4 is joined with the first fixing portion of the centering disk 3. For the diaphragm 4 of the embodiment, the central position of the plane portion also has an annular structure corresponding to the piezoelectric sheet 2, and the diaphragm 4 formed by removing materials from the central position may reduce the weight of the vibration system and improve the acoustic performance of the speaker device.

As shown in FIG. 3, the centering disk 3 is provided with a group of second pads 32*b* corresponding to the voice coil and the second pads 32*b* are welded to lead wire of the voice coil. The first fixing portion 31 is provided with a group of first external pads 31*a* and a group of second external pads 31*b*. The first external pads 31*a* are electrically coupled with the first pads 32*a*, and the second external pads 31*b* are electrically coupled with the second pads 32*b*. Both the first external pads 31*a* and the second external pads 31*b* are electrically connected to external electronic circuits, respectively. The centering disk of the embodiment is provided with a conductive circuit, which may has a flexible conductive circuit board structure. Each of the first fixing portion 31, the second fixing portion 32 and the connecting arm 33 is provided with the conductive circuit thereon to ensure that the piezoelectric sheet and the voice coil are electrically connected to the external circuits.

As shown in FIG. 2, in the speaker device of the embodiment, the piezoelectric sheet 2 is provided at a side of the centering disk 3 away from the diaphragm 4. Such a design facilitates electrical connections of the piezoelectric sheet 2, the voice coil 5 and the centering disk 4, which may simplify circuit design difficulties of the speaker device, reduce production and assembly difficulties of the speaker device and thereby improving the production efficiency.

According to the speaker device of the present invention, the piezoelectric sheet is used to replace a reinforcement portion provided at the central position of the centering disk of the speaker device having a conventional structure, such that the piezoelectric sheet may play the role of the reinforcement portion to improve the acoustic performance of the speaker device; meanwhile, as an independent sound generation unit, the piezoelectric sheet may generate medium-high frequency audio signals, which may supplement the audio signal generated by the voice coil-diaphragm sound generation structure of the present invention. A signal emitted by the piezoelectric sheet is mixed with an audio signal emitted by the voice coil-diaphragm, such that a medium-high frequency effect of the speaker device is effectively improved, and thus the acoustic performance of the speaker device is improved.

The above are merely the embodiments of the present invention and are not intended to limit the present invention. All equivalent modifications or variations made by those skilled in the art according to the disclosure of the present invention should fall within the scope of protection defined in the claims.

What is claimed is:

1. A speaker device, comprising a vibration system, a magnetic circuit system, and an auxiliary system for accommodating and fixing the magnetic circuit system and the vibration system; the vibration system comprises a diaphragm, a centering disk and a voice coil which are joined together; the centering disk comprises a first fixing portion, a second fixing portion provided within the first fixing portion, and a connecting arm for connecting the first fixing portion and the second fixing portion, wherein a central position of the second fixing portion is provided with a piezoelectric sheet, the centering disk is provided with a first pad corresponding to the piezoelectric sheet, and the piezoelectric sheet is electrically connected to the first pad, and the centering disk is further provided with a second pad electrically connected to the voice coil, and the first fixing portion is provided with a first external pad and a second external pad, the first external pad electrically coupled with the first pad and the second external pad electrically coupled with the second pad.

2. The speaker device according to claim 1, wherein the second fixing portion has an annular structure, and an outer periphery of the piezoelectric sheet is fixedly joined with the second fixing portion.

3. The speaker device according to claim 1, wherein the diaphragm comprises a fixing portion, a plane portion at the center, and a suspension ring portion connecting the fixing portion and the plane portion; and the plane portion is fixedly joined with the second fixing portion of the centering disk.

4. The speaker device according to claim 1, wherein both the first pad and the second pad are provided at the second fixing portion.

5. The speaker device according to claim 4, wherein the piezoelectric sheet is provided at a side of the second fixing portion away from the diaphragm.

6. The speaker device according to claim 1, wherein the centering disk is provided with a conductive circuit; and each of the first fixing portion, the second fixing portion and the connecting arm is provided with the conductive circuit.

7. The speaker device according to claim 1, wherein the auxiliary system comprises a front cover and a housing.

8. The speaker device according to claim 7, wherein the centering disk is fixedly provided between the front cover and the housing.

* * * * *